United States Patent [19]

Hafner

[11] 4,366,948

[45] Jan. 4, 1983

[54] CAR JACK

[75] Inventor: Franz X. Hafner, Wurmlingen, Fed. Rep. of Germany

[73] Assignee: E. A. Storz GmbH & Co. KG, Tuttlingen, Fed. Rep. of Germany

[21] Appl. No.: 281,225

[22] Filed: Jul. 6, 1981

Related U.S. Application Data

[63] Continuation of Ser. No. 129,707, Mar. 12, 1980, abandoned.

[30] Foreign Application Priority Data

Mar. 15, 1979 [DE] Fed. Rep. of Germany ..... 2910210

[51] Int. Cl.[3] ..... B66F 3/12

[52] U.S. Cl. ..... 254/126

[58] Field of Search ..... 254/DIG. 1, DIG. 4, 254/98, 99, 100, 101, 126

[56] References Cited

U.S. PATENT DOCUMENTS 4,194,725 3/1980 Erschens ..... 254/126

4,203,577 5/1980 Hafner ..... 254/100

FOREIGN PATENT DOCUMENTS 2539573 4/1976 Fed. Rep. of Germany ..... 254/101

*Primary Examiner*—Robert C. Watson

*Attorney, Agent, or Firm*—Shenier & O'Connor

[57] ABSTRACT

A car jack having a stand column secured at its lower end to a plate-like base and pivotally supporting an arm having a head for engaging a vehicle and adapted to be pivoted by a threaded spindle rotated by a hand crank, in which the base has relatively angularly disposed front and rear portions forming a transverse edge on which the jack tilts when raising, a car with a major portion of the front base portion underlying the stand column with the front base portion having a central supporting zone projecting downwardly below side zones with means at the side zones connecting the base to the stand column.

6 Claims, 7 Drawing Figures

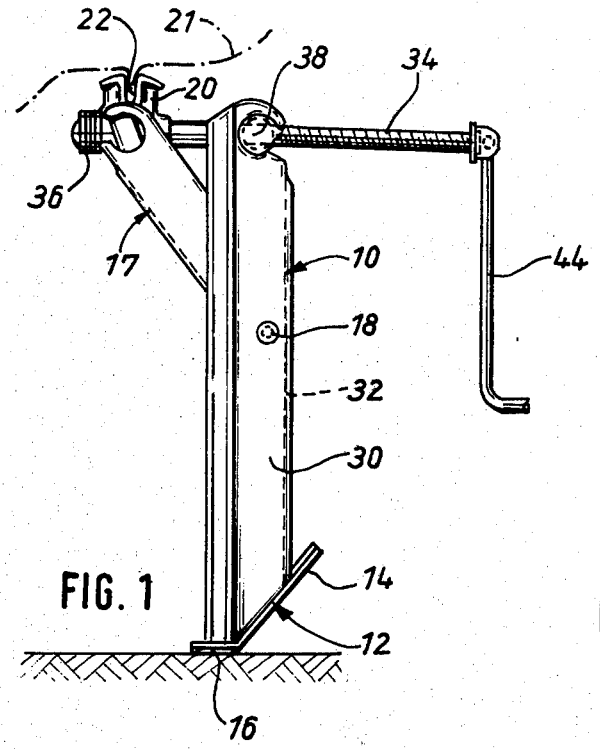
FIG. 1
FIG. 2
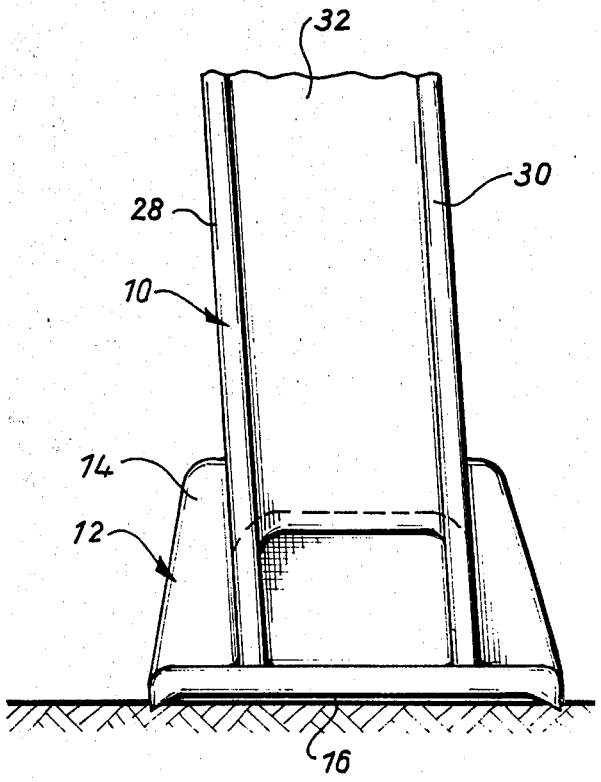

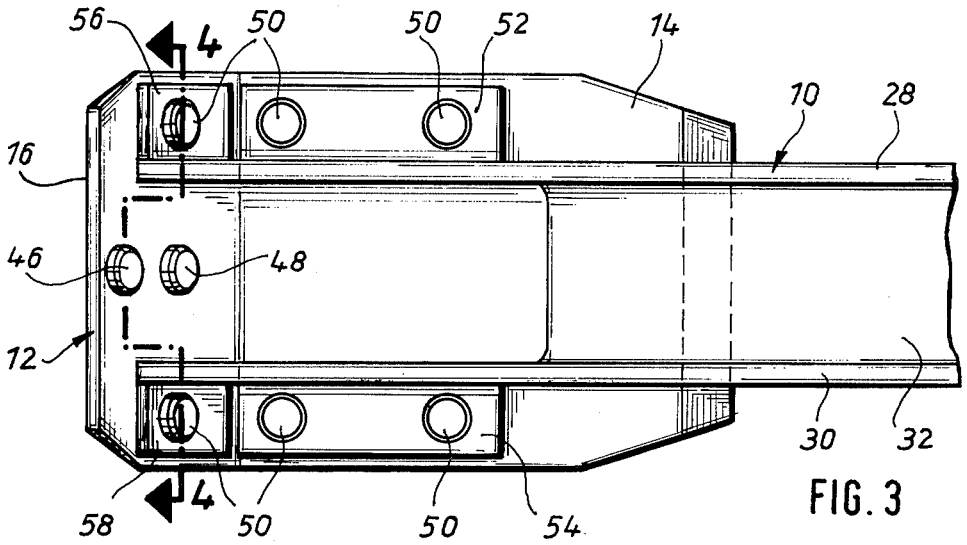
FIG. 3
FIG. 4
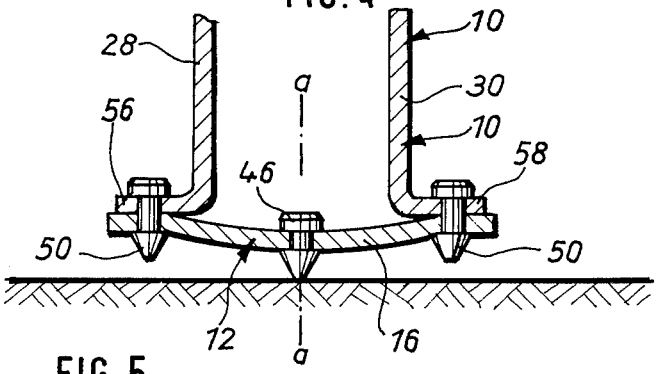
FIG. 5
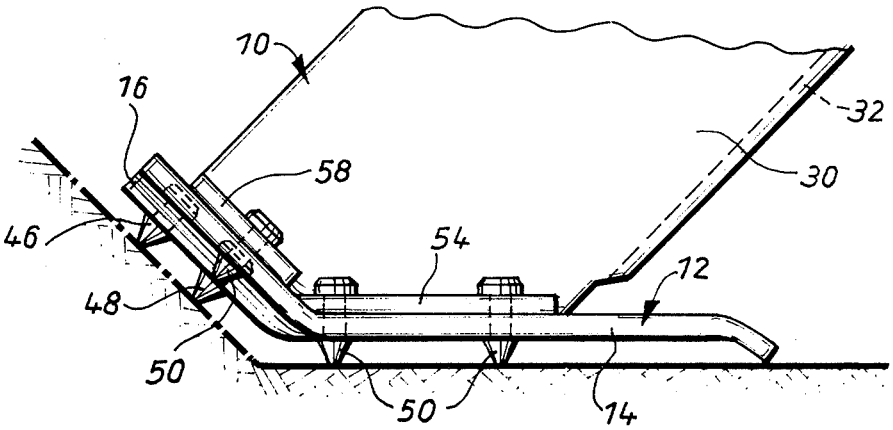

CAR JACK

This application is a continuation of application Ser. No. 129,707, filed Mar. 12, 1980 and now abandoned.

The invention relates to a car jack.

In the known car jacks, the supporting arm and the base consist of steel profiles.

Continued attempts have been made to reduce the weight of such car jacks, which, among other means, was achieved to a substantial extent by appropriate profiling of the arms of the metal profiles in longitudinal direction. This made it possible to reduce the wall thicknesses of the metal profiles correspondingly.

However, new requirements have been raised in motor vehicle construction with regard to weight reduction, which cannot be achieved with the hitherto employed steel profiles. It has therefore already been attempted to obtain the required, greatly reduced maximum weight of such car jacks by the use of other materials, namely light metal, in which rather favourable results have been achieved. It was found however in the course of these attempts that a simple substitution of construction materials whilst retaining the conventional structural embodiment is not sufficient to achieve an adequate inherent and torsional rigidity, not even by substantially increasing for this purpose the wall thicknesses of the metal profiles The weak point of such a structure was found to be the base. The latter, even with an appropriate material thickness and profiling, remains elastically yielding under extreme loadings owing to its relatively low strength to such an extent, that the shanks of the stand column, as viewed in their longitudinal direction, can be displaced under certain circumstances by as much as several millimeters due to twisting of the stand column relative to each other. Such a case can occur when a raised vehicle stands on a slightly sloping road. In this case, such a jointed lever must be applied to the car body in such a manner, that its stand column comes to be located substantially in a plane perpendicular to the ground surface. If then the vehicle is raised and forces oriented in longitudinal direction of the vehicle appear, which may be caused by the action of the wind or by a person leaning against the car body, the stand column, owing to the elasticity of the light metal, will correspondingly incline in the direction of the force, although the base will substantially retain its plane position on the ground surface. From this obliqueness of the stand column there results a mutual displacement of its profile members in longitudinal direction, which also brings about a corresponding displacement of the transverse pivot axle of the supporting arm and thus a torsion of the latter, because its load head is fast on the vehicle body while under load. This twisting of the stand column relative to the base and the torsion of the supporting arm is unacceptable for safety reasons, although these parts, when free of load, can return in their original positions.

The purpose underlying the invention therefore is one of providing a car jack having a structural embodiment, the construction of which makes it possible to manufacture it from light metal with a weight which is substantially reduced by comparison with the conventional car jacks, in which the stand column and the supporting arm cannot undergo twisting and torsion, respectively, in the load-bearing state and when its stand column is inclined under the effects of a force in a direction parallel to the longitudinal direction of the vehicle.

In such a car jack, its base, in the raised state of a vehicle, contacts the supporting ground surface only with its raised portion, so that the base, when forces displacing the vehicle body appear, can tilt in their direction. This ensures, that in any relative position of the stand column to the ground surface, the base will retain its original position relative to the stand column under any condition of loading of the car jack, so that no bending forces capable of twisting the stand column can appear at the points of connection between these two parts.

The raised portion of the base can be constituted by a pressing having for example circular cross-section. It can furthermore be embodied in the form of a pressed longitudinal bead extending in the plane of the supporting arm and stand column. In this case, it is advantageous if the raised portion has a greater resistance to pressure than the remainder of the positioning surface of the base. Such a partial increase of pressure resistance on the positioning surface can be obtained in a simple manner.

A preferred form of embodiment of the car jack base is that, owing to which the position of the tiltable base plate on the ground surface can be rendered particularly secure against slipping.

Further features and details of the invention are explained in the following description of an example of embodiment illustrated in the drawing. In the drawing:

FIG. 1 shows a hinged car jack in light metal construction, the structure of which identically corresponds to that of a hinged car jack in steel construction, its supporting arm being in the maximum lift position, in which the stand column is held on the supporting surface of the tiltable base plate;

FIG. 2 is a front elevation of the lower portion of the stand column of the hinged car jack according to FIG. 1, on a larger scale than FIG. 1, the stand column and tiltable base plate of which are distorted owing to forces acting in the longitudinal direction of a raised passenger vehicle;

FIG. 3 is a plan view of the end-piece of the stand column carryingthe tiltable base plate in a hinged car jack according to the invention;

FIG. 4 is a section through the tiltable base plate and a portion of the stand column, taken along the line 4—4 oF FIG. 3;

FIG. 5 is a side elevation of the lower end-piece of the stand column which carries the tiltable base plate of the car jack according to the invention;

Figure 6:
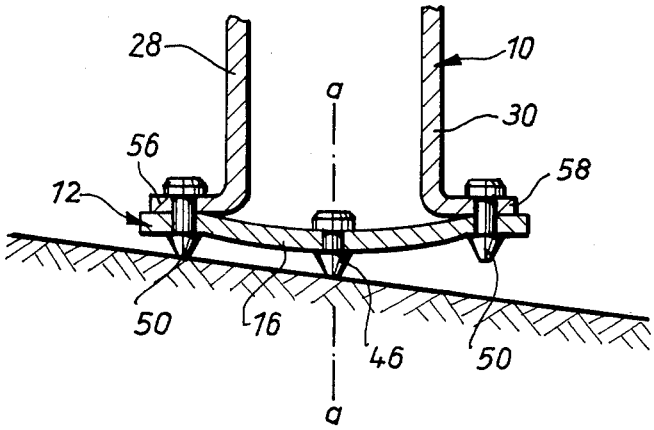
FIG. 6 is a presentation corresponding to that of FIG. 4, where however the hinged jack is set up on a downward-sloping ground surface.

The hinged jack shown in FIGS. 1 and 2 is intended to illustrate, for the purpose of better understanding, that a hinged car jack in light metal construction and identical in embodiment to a steel car jack does not have the torsional strength of such a hinged car jack, even if its profiles for the stand column and the supporting arm are given correspondly stronger dimensions.

The illustrated hinged jack has a stand column 10 of U-shaped cross-section, which carries at its lower end for example a tiltable base plate 12, which in known manner has a rear bearing surface 14 and, at an obtuse angle to the latter, a frontal supporting surface 16.

At approximately mid-point of the stand column, one end of a supporting arm referenced 17 is mounted pivotable about a transverse pivot axle 18, the free lever end of which has in a known manner a load head 20, by means of which the supporting arm 17 can be applied to the underside of the body of a vehicle to be raised 21, indicated in composite lines.

The load head 20, which is constituted for example of a heavy plastic moulding, has e.g. on its load-bearing face a groove-like recess 22, extending perpendicularly to the plane of the drawing and located in the centre of the load head, which serves for accommodating a web of the car body constituted by a tie seam.

The transverse pivot axle 18 is disposed in the arms referenced 28 and 30 of stand column 10 at a distance from a tie referenced 32 which interconnects the two sections of the stand column.

The supporting arm 17 is pivotable about the transverse pivot axle 18 with the aid of a threaded spindle 34, which pierces with one of its end-pieces the load head 20 and is mounted therein rotatable but undisplaceable in axial direction, whilst when the supporting arm 17 is swung upwards, the threaded spindle 34 is supported on a thrust bearing 36.

The axial movement of the threaded spindle 34 required for pivoting the supporting arm 17 is provided by a threaded nut 38, which is located in a bushing fitted on the upper end of stand column 10. Reference 44 designates a hand crank, preferably a tumbling-action crank secured for rotation to the upper end of the threaded spindle 34, for effecting the rotation of the latter.

The supporting arm 17 also has a profile of U-shaped cross-section, the two shanks of which are disposed at such a distance from each other, that the supporting arm can be mounted with slight lateral play between the shanks 28, 30 of the stand column on the transverse pivot axle 18. In its lower starting position the supporting arm extends over the major portion of its length between the shanks 28, 30 of the stand column.

The stand column 10 and the tiltable base plate 12 are made fast to each other by welding.

The sole difference between this hinged jack embodied in light construction and a known hinged jack in steel construction consists in that the stand column, the supporting arm and the tiltable base plate are made of corresponding aluminium sections or aluminium sheet instead of steel sections or steel sheet. Such a substitution of materials makes possible a substantial reduction in weight in such hinged jacks. However, it was found in the course of experiments that the high torsional strength of hinged jacks made of steel, with regard to the mutual disposition of stand column and tiltable base plate, cannot be achieved even when the base or the shanks of the base plate are given a profiled embodiment instead of a plane construction. On the other hand, for reasons of the desired weight reduction, the wall thicknesses of stand column and tiltable base plate cannot be increased at will.

FIG. 2 illustrates that a mere substitution of materials, namely the use of aluminium instead of steel, does not by itself suffice to provide a hinged jack of adequate torsional strength with substantially reduced weight.

With regard to the illustration according to FIG. 2, let it be assumed for example that forces oriented in its longitudinal direction come to act on the raised vehicle 21, be it by the influence of wind, or by the positioning of the vehicle on a sloping road. As was determined by exhaustive tests, under the effect of such forces the stand column 10 positions itself to a considerable extent obliquely to the base plate, whilst its positioning surface 16, even under the influence of the absorbed load, substantially retains its position relative to the ground surface. Apart from the fact, that this yielding between stand column and base plate can cause the car jack to fall ever as the action of the forces is intensified, the stand column is thereby twisted to such an extent, that its shanks, in the longitudinal direction, are displaced correspondingly relative to each other. This in turn causes a corresponding displacement of the transverse pivot axle 18 and thereby a torsion of the supporting arm, since the load head 20 is fixed in position on the vehicle body.

By the embodiment of the base according to the invention, for example in the form of a tiltable base plate, as will be described in the following with reference to FIGS. 3 to 5, it can be achieved, that the relative disposition of base and stand column, in spite of the elasticity inherent to the use of the material, is preserved in the region of their mutual connection should a displacement of the load-bearing point occur, and thus the occurrence of damaging bending and torsional moments at the point of connection between stand column and base is effectively prevented.

For this purpose, the positioning surface 16 of the tiltable base plate 12 has spaced one behind the other for example, two protrusions formed preferably by steel rivets 46, 48 disposed in the tiltable base plate, which are arranged symmetrical to a plane a-a in which the longitudinal axes of stand column 10 and supporting arm 17 are located. The protrusions formed by the two rivets are bounded relative to the extension of the positioning surface 16 to both sides of this plane. They thus define bearing points which ensure that in a position of the stand column which deviates from the perpendicular to the ground surface when the vehicle is raised and, alternatively, in the case of a non-plane ground surface, there is still a centric force engagement is established on the positioning surface of the tiltable base plate, so that only small unilateral load couples can occur on the tiltable base plate. This prevents a twisting of the hinged jack in the region of the tiltable base plate in the manner illustrated in FIG. 2, with a corresponding torsion of the stand column.

Even in the case where the vehicle is to be raised on a sloping road, as shown for example in FIG. 6, a load acceptance symmetrical to the above-mentioned plane a-a is ensured. Should it happen in this case that a longitudinal edge portion of the positioning surface comes into contact with the ground surface, then an elastic deformation will occur, but to such insignificant extent only that no detrimental changes can occur on the stand column. In addition, in this case the strength of the material will effect, that after discharge of the load the relative displacement of tiltale base plate and stand column is again compensated.

Instead of the two rivets 46, 48 it is also possible to provide a single protrusion constituted by a corresponding pressing in the base plate. Further, the protrusion can be formed by a longitudinal corrugation extending in the plane a-a.

By the use of steel rivets 46, 48 which, to avoid electrolytic corrosion, are to be disposed insulated in the tiltable base plate preferably made of aluminium, additionally a high resistance to slipping of the hinged jack on the ground surface will be achieved.

In the example of embodiment shown, the positioning surface 14 and supporting surface 16 of the tiltable base plate are moreover provided with spaced steel rivets 50 forming anchoring claws, of which those in the supporting surface 16 are correspondingly set back in height relative to those steel rivets 46, 48 which are located in the plane a-a of supporting arm and stand column. With this end in view, in the present example of embodiment, the supporting surface 16 for example is convexly arched outward transverse to the longitudinal direction of the base plate. Here, the disposition of the two median steel rivets 46, 48 on the supporting surface is such, that the rear steel rivet 48 is located approximately in the plane of the two outer steel rivets 50. In addition, the two steel rivets 50 serve at the same time for fastening the base plate 12 to the stand column 10, in that they are riveted to the base plate with corresponding side flanges 52, 54 and 56, 58 respectively.

Figure 7:
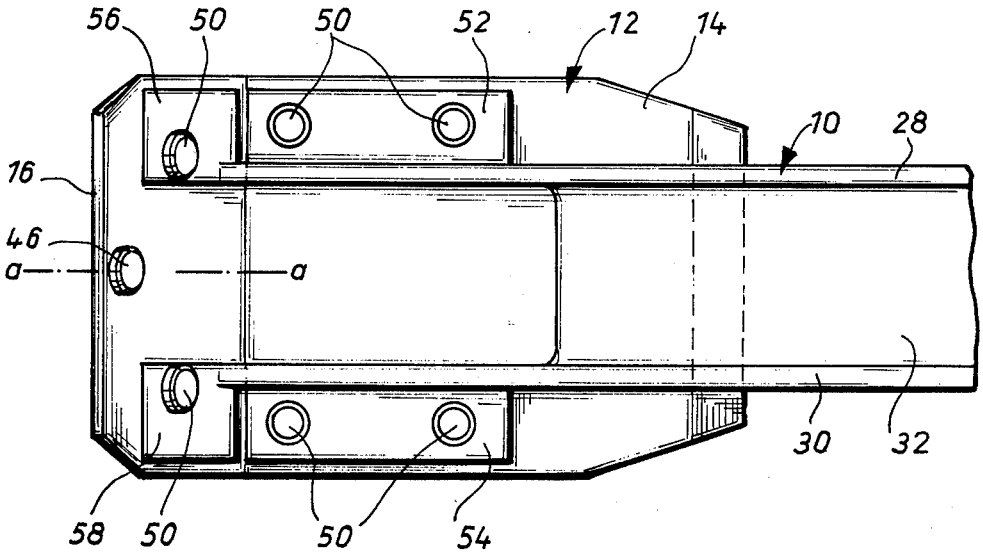
FIG. 7 is a presentation similar to FIG. 3 for illustrating a constructional variant of the tiltable base plate.

As FIG. 7 shows, the supporting surface 16 can also be provided with only the steel rivet 46. Further, the lateral rivets 50 may be at a smaller distance from the plane a-a than the rivets 50 provided on the positioning surface 14. By such an arrangement of the rivets, the degree of freedom of the supporting surface 16 relative to the ground surface can be further substantially increased.

It is obvious, that the construction of the tiltable base plate, for satisfying the purpose underlying the invention, can be modified in many different ways; the only essential point is that the construction according to the invention ensures, in case of the stand column assuming an oblique position or being positioned obliquely to the ground surface, that the load bearing point of the supporting surface is not displaced or only insignificantly so in lateral direction relative to the plane a-a.

Having thus described my invention, what I claim is:

1. A car jack of the type having a stand column and a supporting arm which is pivotable about a transverse pivot axle mounted on the stand column and is equipped with a bearing head for engaging a vehicle and is pivotable by means of a threaded spindle rotatable by a hand crank, in which the supporting arm and the stand column are constituted by metal profiles of substantially U-shaped cross section, said stand column being rigidly connected at its lower end with a plate-like supporting base having a front base portion and a rear base portion disposed at an angle to said front base portion, said portions thus forming a transverse edge between them over which edge the jack tilts when raising a car, wherein the stand column, supporting arm and supporting base consist of light metal, at least the major part of the front base portion is arranged under the stand column, the rear base portion having supporting zones for contacting the ground which are all at the same level, and the front base portion has a central supporting zone between two side zones in a plane defined by the longitudinal axis of the stand column and the supporting arm, said central supporting zone projecting downwardly beyond said side zones, means at said side zones connecting the supporting base to the stand column.

2. A car jack as in claim 1 in which said front base portion has an arcuate cross-sectional shape.

3. A car jack as in claim 1 in which said rear base portion supporting zones and said front base portion side supporting zones are formed by steel rivets.

4. A car jack as in claim 3 in which two of said rear base portion rivets closest to said front base portion are located at the points of intersection of the hypotenuse and the two short sides of an obtuse triangle, the point of intersection of the short sides of which is approximately at said central supporting zone.

5. A car jack as in claim 1 in which said stand column has flanges at the base thereof, said connecting means comprising rivets extending through said front base portion and said flanges.

6. A car jack as in claim 5 in which said rivets have heads comprising said side supporting zones.

* * * * *